US005867953A

United States Patent [19]

Amundsen

[11] Patent Number: 5,867,953

[45] Date of Patent: Feb. 9, 1999

[54] HOLE/POLE BOOT SYSTEM

[76] Inventor: M. Shaun Amundsen, 1025 Oxford La. #64F, Ft. Collins, Colo. 80525

[21] Appl. No.: 968,638

[22] Filed: Nov. 12, 1997

[51] Int. Cl.[6] ..... E02D 27/42

[52] U.S. Cl. ..... 52/170; 52/146; 52/152; 52/165; 52/169.13; 52/741.3; 52/741.4; 47/23

[58] Field of Search ..... 52/63, 146, 152, 52/165, 170, 222, 169.13, 741.3, 741.4; 47/23, 25

[56] References Cited

U.S. PATENT DOCUMENTS

| | | | |
|---|---|---|---|
| 369,616 | 9/1887 | Rowe et al. | 47/23 |
| 389,047 | 9/1888 | Birth | 52/169.13 X |
| 472,137 | 4/1892 | McCallip | 47/23 |
| 602,941 | 4/1898 | Harvey | 47/23 |
| 2,978,837 | 4/1961 | Daniels | 47/25 |
| 4,268,992 | 5/1981 | Scharf, Sr. | 47/23 |
| 5,016,388 | 5/1991 | Burress et al. | 47/23 |

*Primary Examiner*—Christopher Kent
*Attorney, Agent, or Firm*—Dean P. Edmundson

[57] ABSTRACT

A boot system and method are described for preventing water or debris from entering a hole in the ground in which a pole has been placed prior to filling the hole with dirt or concrete. A flexible sheet is attached to the pole above the ground, and the lower edge of the sheet is secured to the ground around the pole. The side edges of the sheet are connected together. This system sheds water and keeps all foreign material out of the hole.

8 Claims, 2 Drawing Sheets

HOLE/POLE BOOT SYSTEM

FIELD OF THE INVENTION

This invention relates to pole building construction. More particularly, this invention relates to techniques and systems for protecting holes in the ground from rain or debris.

BACKGROUND OF THE INVENTION

Pole building construction initially involves drilling or digging holes in the ground in which long vertical poles are set. To prevent the poles from settling lower into the ground than desired, an oversized concrete pad or base is placed at the bottom of the hole for the pole to rest on. The diameter of the concrete pad is preferably larger than the diameter of the pole.

In some locations of the country, local building codes require inspection of the hole and concrete pad before the hole can be filled in with dirt and packed around the pole. Unfortunately, there is often a period of delay between when the holes are dug and when the inspector is able to make the necessary inspection. In the meantime, depending upon the weather, rain or snow could cause the hole to become filled (or partially filled) with water or snow. It is also possible for dirt or debris to fall into the hole before the necessary inspection is made. As a result, it may be necessary to remove the pole and dig out any foreign material which may have fallen into it before the inspection can be made.

There has not heretofore been provided a system for protecting holes in the ground having the features and advantages provided by the present invention.

SUMMARY OF THE PRESENT INVENTION

In accordance with the present invention there is provided a boot system for protecting a hole in the ground to prevent rain, snow, dirt, or debris from falling into the hole prior to inspection. The boot system is intended for use around a pole which extends generally vertically out of the hole. In a preferred embodiment the system comprises:

(a) a sheet of flexible, water-resistant material having an upper edge, lower edge, and two side edges; wherein the upper edge is shorter than the lower edge;

(b) adjustable for fastening means for detachably fastening the upper edge of the sheet around the pole at a point above the ground;

(c) closure means for closing the sheet around the pole by connecting the side edges of the sheet; and (d) securing means for securing the lower edge of the sheet to the ground.

The boot system of the invention is very easy to install and is readily adaptable to any desired diameter of pole, regardless of length. The lower edge of the boot can be secured to the ground around the hole with stakes, for example, so that wind or water cannot disrupt the boot.

Other features and advantages of the boot system will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
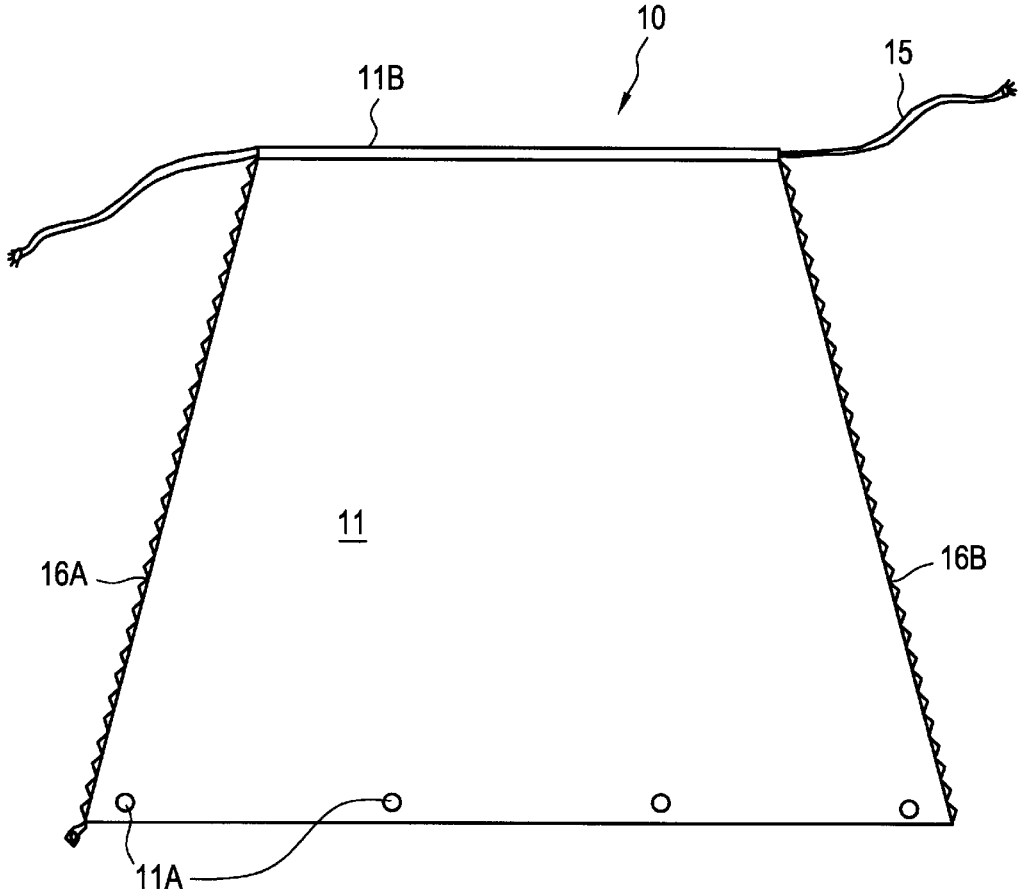
FIG. 1 is a plan view of the boot system prior to installation around a pole.
Figure 2:
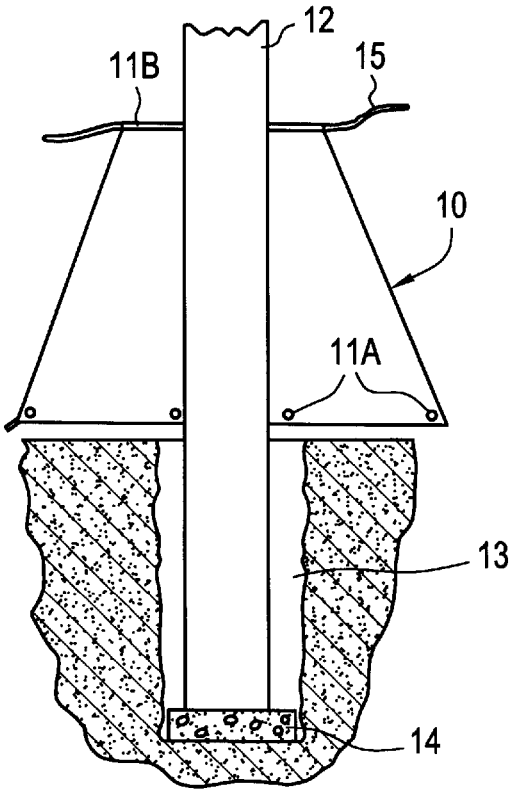
FIG. 2 is a side elevational view showing a generally-vertical pole extending out of a hole in the ground with the boot system ready to be placed around the pole.
Figure 3:
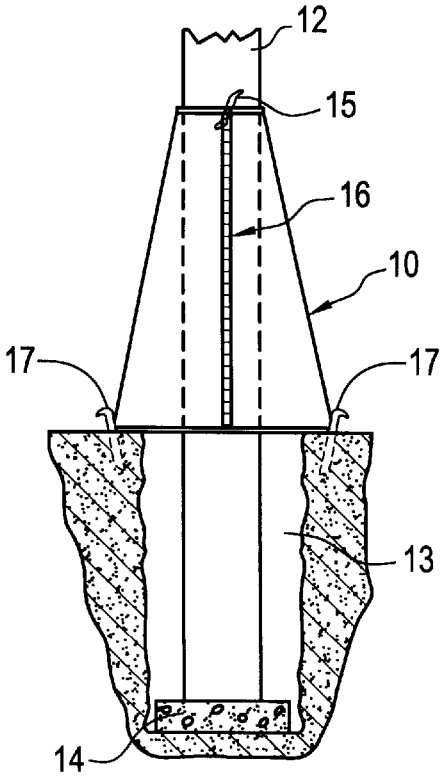
FIG. 3 is a side elevational view of the boot system placed around the pole and secured to the ground.

In FIGS. 1–3 there is illustrated one embodiment of boot system 10 of the invention for temporary placement around a generally-vertical pole 12 in hole 13 in the ground. The base of the pole is supported on a concrete pad 14 at the bottom of the hole.

The boot system comprises a sheet 11 of flexible, water-resistant material (e.g., plastic, rubber, oiled canvas, etc.) which has upper and lower edges and two side edges. The upper edge is shorter than the lower edge so that the boot slopes outwardly from top to bottom after it has been installed around the pole, as illustrated. In other words, the boot system is conical in shape when it is installed so that it will shed water, snow, etc. away from the hole.

The lower edge of the sheet includes apertures or openings 11A to enable ground spikes or stakes 17 to pass through for securing the bottom edge to the ground at a distance outwardly from the hole in the ground.

The upper edge of the sheet includes a rolled over edge 11B forming a passageway for a flexible cord or draw string 15. Alternatively, the string 15 could be firmly secured to the upper edge of the sheet.

After the upper edge of the sheet has been extended around the pole at the suitable height, the string 15 is drawn tight and tied. This will hold the upper edge of the sheet in a desired elevated position and it will also prevent water, snow, etc. from getting into the hole from the top.

The side edges of the sheet are intended to be connected together around the pole. For this purpose it is possible to use a zipper 16 (with one zipper section 16A on one side edge and zipper section 16B on the opposite side edge).

Figure 4:
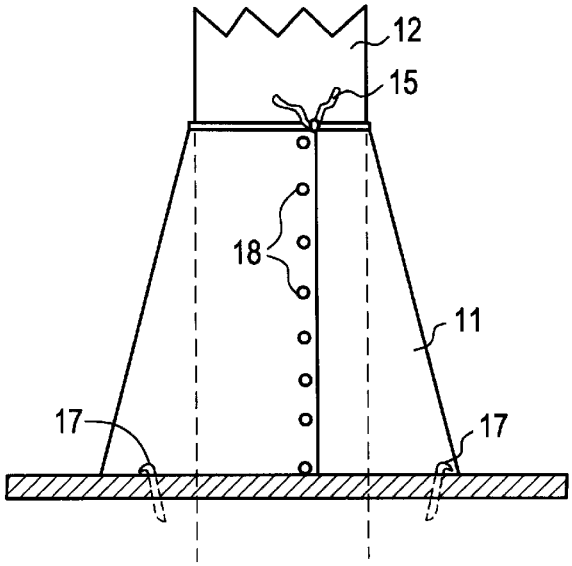
FIG. 4 is a side elevational view of another embodiment of boot system of the invention placed around a pole and secured to the ground.

Another embodiment of the boot system is shown in FIG. 4 where the zipper has been replaced with a plurality of snap fasteners 18. Other equivalent fastener means could also be used for this purpose, if desired.

The dimensions of the sheet material may vary. A particularly suitable size is a sheet having an upper edge about three feet long, a lower edge about five feet long, and side edges which are about four feet long. Other dimensions could also be used, if desired.

Other variants are possible without departing from the scope of this invention. The boot system can be rapidly installed around a pole, and then it is easily and quickly removed when desired. It can be stored in flat or rolled condition.

What is claimed is:

1. A boot system for placement around a pole extending generally vertically from a hole in the ground, the boot system comprising:

(a) a sheet of flexible, water-resistant material having an upper edge, a lower edge, and two side edges; wherein said upper edge is shorter than said lower edge;

(b) adjustable fastening means for detachably fastening said upper edge of said sheet around said pole at a point above the ground;

(c) closure means for closing said sheet around said pole by connecting said side edges of said sheet; and (d) securing means for securing said lower edge of said sheet to the ground.

2. A boot system in accordance with claim 1, wherein said sheet comprises plastic.

3. A boot system in accordance with claim 1, wherein said fastening means comprises a flexible cord carried by said upper edge of said sheet.

4. A boot system in accordance with claim 1, wherein said closure means comprises a zipper.

5. A boot system in accordance with claim 1, wherein said securing means comprises a plurality of stakes for driving into the ground around said pole, and further including means for attaching said stakes to said lower edge of said sheet.

6. A boot system in accordance with claim 1, wherein said upper edge of said sheet has a length of about three feet, said lower edge of said sheet has a length of about five feet, and each said side edge has a length of about four feet.

7. A boot system in accordance with claim 1, wherein said closure means comprises mating snaps on said side edges.

8. A method for preventing water or debris from entering a hole in the ground in which an elongated pole is positioned prior to filling the hole with soil or concrete, the method comprising the steps of:

(a) providing a flexible, water-resistant sheet having an upper edge, a lower edge, and two side edges;
wherein said upper edge is shorter than said lower edge;

(b) extending said upper edge of said sheet around said pole at a point above the ground and fastening said upper edge of said pole;

(c) extending said lower edge of said sheet around said pole at ground level and connecting said side edges together;

(d) securing said lower edge of said sheet to the ground at a plurality of locations around said pole.

* * * * *